United States Patent [19]

Yang

[11] Patent Number: 4,838,051

[45] Date of Patent: Jun. 13, 1989

[54] PADLOCK AND KEY ASSEMBLY WITH TRANSVERSELY MOVABLE TUMBLER UNITS AND VERTICALLY MOVABLE TUMBLER UNITS

[76] Inventor: Yaw-Mein Yang, No. 5, Lane 88, Min-Tsu St., Pei-Tou Chen, Changhua Hsien, Taiwan

[21] Appl. No.: 186,902

[22] Filed: Apr. 27, 1988

[30] Foreign Application Priority Data

Feb. 10, 1988 [TW] Taiwan ..... 75203983

[51] Int. Cl.[4] ..... E05B 67/24

[52] U.S. Cl. ..... 70/38 A; 70/358; 70/491; 70/DIG. 37

[58] Field of Search ..... 70/358, 38 A, 38 B, 70/38 C, 38 R, 392, 491, 402–404, 421, 493, DIG. 23, DIG. 37

[56] References Cited

U.S. PATENT DOCUMENTS

| | | | |
|---|---|---|---|
| 883,414 | 3/1908 | Merrill | 70/38 A |
| 1,419,359 | 6/1922 | Christoph | 70/38 A |
| 2,093,925 | 9/1937 | Pickop | 70/403 |
| 2,557,028 | 6/1951 | Deutsch | 70/491 |
| 3,605,461 | 9/1971 | Frank | 70/491 |
| 4,445,347 | 5/1984 | Tseng | 70/421 X |

FOREIGN PATENT DOCUMENTS

| | | | |
|---|---|---|---|
| 2828343 | 1/1980 | Fed. Rep. of Germany | 70/358 |
| 2313526 | 12/1976 | France | 70/491 |
| 2525267 | 10/1983 | France | 70/491 |
| 0435642 | 5/1948 | Italy | 70/491 |

*Primary Examiner*—Lloyd A. Gall

*Attorney, Agent, or Firm*—Christie, Parker & Hale

[57] ABSTRACT

A padlock and key assembly includes a padlock and a cylindrical key. The padlock includes a lock body, and a key plug which is locked in the lock body by transversely movable tumbler units and vertically movable tumbler plate units. The key includes annular grooves formed in its outer surface, and push blocks extending radially from the key. When the key is inserted into the key plug, the annular grooves engage with the tumbler pin units and the push blocks engage with the tumbler plate units so that the key plug is unlocked from the lock body, thereby enabling the key plug to rotate with the key.

1 Claim, 5 Drawing Sheets

PADLOCK AND KEY ASSEMBLY WITH TRANSVERSELY MOVABLE TUMBLER UNITS AND VERTICALLY MOVABLE TUMBLER UNITS

CROSS REFERENCE TO RELATED APPLICATION

Subject matter common to that contained herein is disclosed in co-pending application Ser. No. 186,628, filed on even date herewith.

BACKGROUND OF THE INVENTION

This invention relates to a padlock and key assembly, and more particularly to one which has transversely movable tumbler units and vertically movable tumbler units.

The improvement of this invention is directed to a conventional pin-tumbler padlock of the type shown in FIG. 1. This conventional padlock includes a body 11, a lock core or key plug 12 mounted rotatably within the body 11, a shackle 13 having long and short legs, and locking bolt members 14 and 15. Four spring biased tumbler units 16 pass through the body 11 and key plug 12 for preventing the rotation of the key plug 12 relative to the body 11. The key plug 12 has a key hole 121 which is shaped to mate with a flat key 17 (see FIG. 2) or a cylindrical key 18 (see FIG. 3). When mating the key hole 121 with the flat key 17, the flat key 17 is first inserted into the key hole 121 so that the tumbler units 16 are moved to release the key plug 12 from the body 11, and then the flat key 17 together with the key plug 12 are rotated. Each of the locking bolt members 14 and 15 has an inner L-shaped arm 141, 151, and an outer tapered arm 142, 152. The tapered arms 142 and 152 are respectively inserted into two notches 131 and 132 of the shackle 13 for retaining the short leg of the shackle 13 on the body 11. Upon rotation of the key plug 12, the upper end tenon 123 of the key plug 12 pushes the L-shaped arms 141 and 151 inward so that the tapered arms 142 and 152 separate from the notches 131 and 132 respectively, as shown in FIG. 4. In response to the separation of the bolt members 14 and 15 from the shackle 13, a spring pushes the shackle 13 upward so that the short leg of the shackle 13 separates from the body 11, thereby opening the padlock. Because the flat key 17 is thin and the opening of the key hole 121 is small, it is difficult to mate the key hole 121 with the flat key 17 in poor lighting. When the key hole 121 is mated with the cylindrical key 18, the cylindrical key 18 is inserted into the key hole 121 to engage an interior transverse pin 122 fixed in the key plug 12 with the end slot 181 of the cylindrical key 18. This engagement of the pin 122 with the slot 181 permits the synchronous rotation of the cylindrical key 18 and the key plug 12. The cylindrical key 18 is then rotated in the same manner as that of the flat key 17 to open the padlock. Although it is easy to mate the key hole 121 with the cylindrical key 18, the transversely movable tumbler units 16 are not sufficient to ensure the safety of the padlock.

SUMMARY OF THE INVENTION

It is therefore the main object of this invention to provide a safe padlock which has transversely movable tumbler units and vertically movable tumbler units.

According to this invention, a padlock and key assembly includes a padlock and a cylindrical key. The padlock includes a lock body, a spring biased shackle having long and short legs connected movably to the upper portion of the body, a locking bolt member for retaining releasably the short leg of the shackle on the body, a sleeve fixed in the body, and a key plug mounted rotatably within the sleeve and having a first annular groove formed in its outer surface, and two opposed channels formed vertically in the key plug and crossing the first annular groove. Each of the channels has an open end in the bottom surface of the key plug. Two stop pins are fixed on the sleeve and respectively extend through a portion of the first annular groove of the key plug near one of the channels. Two spring biased tumbler plates are mounted slidably within the respective channels. Each of the plates has a cutout therein and is biased to extend across a portion of the first annular groove of the key plug for obstructing the corresponding stop pin with a portion of the plate other than the cutout for preventing the rotation of the key plug relative to the sleeve. A plurality of spring biased tumbler pin units transversely extend through the sleeve and the key plug for preventing the rotation of the key plug relative to the sleeve. The cylindrical key includes a plurality of second annular grooves formed in its outer surface, and two opposed push blocks extending radially from the key. Each of the second annular grooves is spaced from the upper ends of the push blocks at a predetermined distance.

When the key is inserted into the key plug, the tumbler pin units engage with the respective second grooves so that the tumbler pin units released, and the plates are moved by the respective push blocks to align the stop pins with the cutouts of the plates so that the stop pins can circulate along the first annular groove, thereby permitting the rotation of the key plug relative to the body.

BRIEF DESCRIPTION OF THE DRAWINGS

Other features and advantages of this invention will become apparent in the following detailed description of a preferred embodiment of this invention with reference to the accompanying drawings in which.

DETAILED DESCRIPTION OF THE PREFERRED EMBODIMENTS

Figure 1:
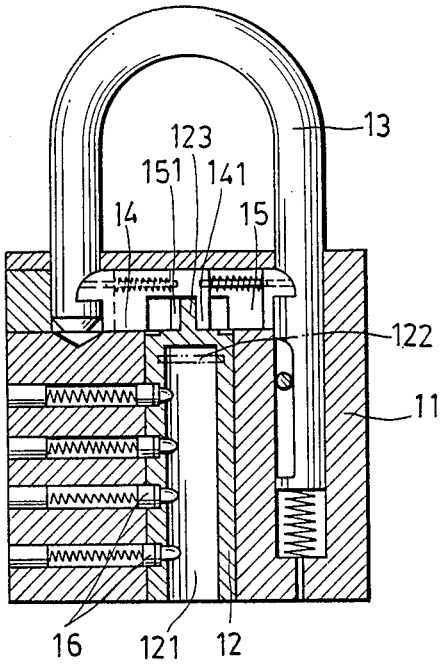
PRIOR ART FIG. 1
FIG. 1 is a sectional view of a conventional padlock when it is locked.
Figure 2:
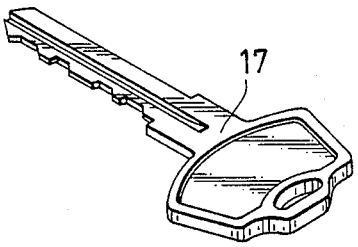
PRIOR ART FIG. 2
FIG. 2 is a perspective view of a conventional flat key.
Figure 3:
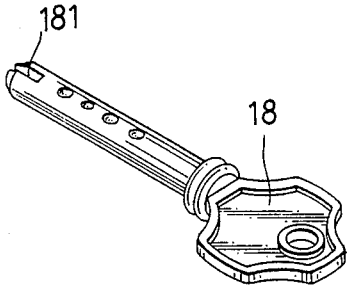
PRIOR ART FIG. 3
FIG. 3 is a perspective view of a conventional cylindrical key.
Figure 4:
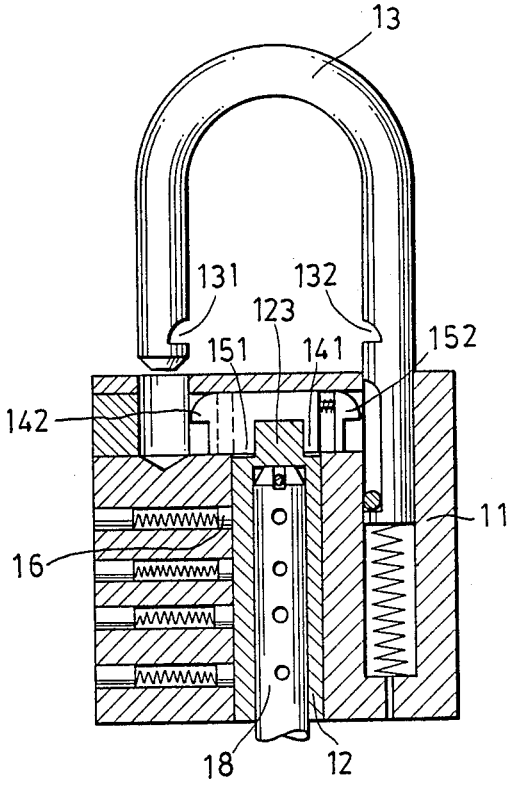
PRIOR ART FIG. 4
FIG. 4 is a sectional view of the conventional padlock when it is open.
Figure 5:
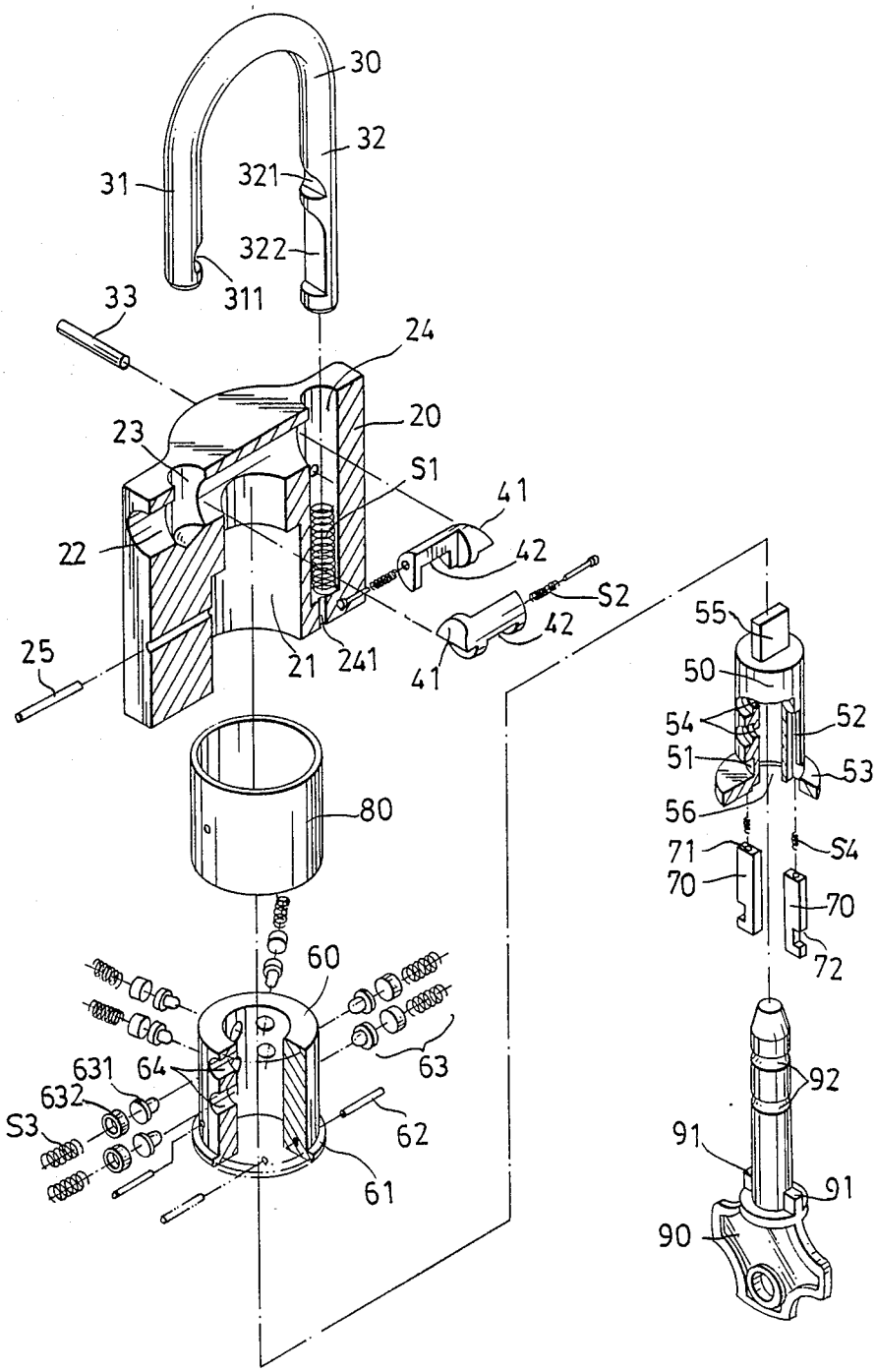
FIG. 5 is an exploded view of a padlock according to this invention.
Figure 6:
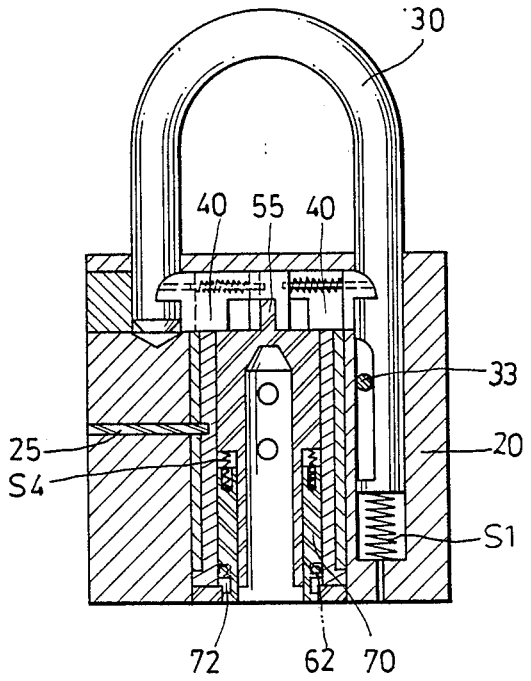
FIG. 6 is a sectional view of the padlock according to this invention when it is locked.

Referring to FIGS. 5 and 6, a padlock of this invention includes a lock body 20, a shackle 30, two locking bolt members 40, and a key plug 50. The body 20 has a bore 21 formed in its bottom surface, a transverse channel 22 communicated with the bore 21, short and long shackle holes 23 and 24 communicated with the channel 22, and a drain passage 241 communicated with the lower end of the long shackle hole 24 for the drainage of rainwater from the long shackle hole 24.

The shackle 30 has a short leg 31 with a notch 311 formed in its inward surface, and a long leg 32 with a notch 321 formed in its inward surface opposite the notch 311 of the short leg 31. The lower end portions of the short and long legs 31 and 32 are respectively received within the short and long shackle holes 23 and 24 of the body 11. The long leg 32 of the shackle 30 has a tapered end 322 which is obstructed by a fixed retainer pin 33 in a known manner so that the long leg of the shackle 30 cannot separate from the body 20.

The bolt members 40 are confined in the channel 22 of the body 11 and respectively inserted into the notches 311 and 321 of the shackle 30 for retaining the short leg 31 of the shackle 30 in the body 11. A first spring S1 is received in the bottom of the long shackle hole 24 for biasing the shackle 30 to move upward. Each of the bolt members 40 has an inner L-shaped arm 42 and an outer tapered arm 41 and is pushed outward by a second spring S2. When the padlock is locked, the tapered arms 41 of the bolt members 40 engage with respective notches 311 and 321 so that the shackle 30 cannot move relative to the body 20.

The key plug 50 includes a first annular groove 51, two vertically extending channels 52 open in the bottom surface of the key plug 50 and crossing the first annular groove 51, an outward flange 53 formed at the bottom end of the key plug 50, three pairs of transversely extending tumbler holes 54, an upper end tenon 55 inserted into the L-shaped arms 42 of the bolt members 40, and a key hole 56. The lower end of the first annular groove 51 of the key plug 50 is terminated by the outward flange 53. A master sleeve 60 is sleeved movably on the key plug 50 and has three pairs of tumbler holes 64 associated with the tumbler holes 54 of the key plug 50. A tubular shell 80 is sleeved snugly on the sleeve 60 for confining three pairs of tumbler pin units 63 within the tumbler holes 56 and 64. Each of the tumbler pin units 63 consists of a tumbler pin 631, a tumbler cylinder 632, and a third spring S3. The key plug 50, sleeve 60, and shell 80 together form a lock core assembly. Two tumbler plates 70 are inserted into respective channels 52 of the key plug 50 and each plate 70 is formed in its upper end surface with a drilled hole 71 in which a fourth spring S4 is received for biasing the plate 70 to move downward. Additionally, each of the plates 70 has a cutout 72 which is below the first annular groove 51 of the key plug 50 when the padlock is locked. Each of the plates 70 is divided by the cutout 72 into an upper wide portion and a lower narrow portion. As shown in FIG. 6, the upper portions of the plates 70 are so wide that the plates 70 are obstructed by the outward flange 53 from downward movement away from the key plug 50. Two stop pins 62 are inserted tightly into the sleeve 60 and extend through two opposed portions of the first annular groove 51 of the key plug 50. When the padlock is locked, the plates 70 are pushed downward by respective fourth springs S4 to abut against the outward flange 53 for obstructing respective stop pins 62 so that the key plug 50 cannot rotate relative to the sleeve 60. The transversely movable tumbler pin units 63 and the vertically movable tumbler plates 70 together form a double lock between the key plug 50 and the sleeve 60.

As illustrated, an associated cylindrical key 90 includes two opposed push blocks 91 extending radially therefrom, and two second annular grooves 92 formed in its outer surface.

In assembly, the first spring S1 is placed into the long shackle hole 24 of the body 20. The long leg 32 of the shackle 20 is also inserted into the long shackle hole 24 of the body 20 so that the retainer pin 33 is inserted into the body 20 for preventing the separation of the long leg 32 of the shackle 30 from the body 20. The bolt members 40 are then placed into the channel 22 of the body 20. The opening of the channel 22 is sealed by a sealing block. The short leg 31 and the long leg 32 of the shackle 30 are depressed to push the bolt members 40 inward. When the shackle 30 arrives at its lowermost position in the body 20, the notches 311 and 321 of the shackle 30 are aligned with the bolt members 40 so that the bolt members 40 are pushed outward by respective second springs S2 to engage with respective notches 311 and 321.

The fourth springs S4 are respectively placed into the drilled holes 71 of the plates 70, and then the plates 70 are inserted into the part of the channels 52 of the key plug 50 above the outward flange 53 so that the plates 70 are biased by respective fourth springs S4 to move downward. The master sleeve 60 is first sleeved on the key plug 50, and then the tumbler pins 631, tumbler cylinders 632, and third springs S3 are in turn placed into the tumbler holes 54 and 64. The plates 70 are moved upward by hand to align the first annular groove 51 of the key plug 50 with the cutouts 72 thereof so that the stop pins 62 are inserted tightly into the sleeve 60. The shell 80 is then sleeved onto the sleeve 60 for confining the tumbler pin units 63 in the lock core assembly. Subsequently, the lock core assembly is inserted into the bore 21 of the body 20. Finally, a positioning pin 25 is passed through the body 20, shell 80, and sleeve 60 for securing the shell 80 and the sleeve 60 in the body 20, thereby forming the configuration shown in FIG. 6.

Because the tumbler pins 631 are flanged, when the third springs S3 push the tumbler cylinders 632 and tumbler pins 631 inward, the tumbler cylinders 632 extend through the interengaging surfaces between the key plug 50 and the sleeve 60 for preventing relative movement therebetween, while the tumbler pins 631 extend only partially out of the tumbler holes 54.

Figure 7:
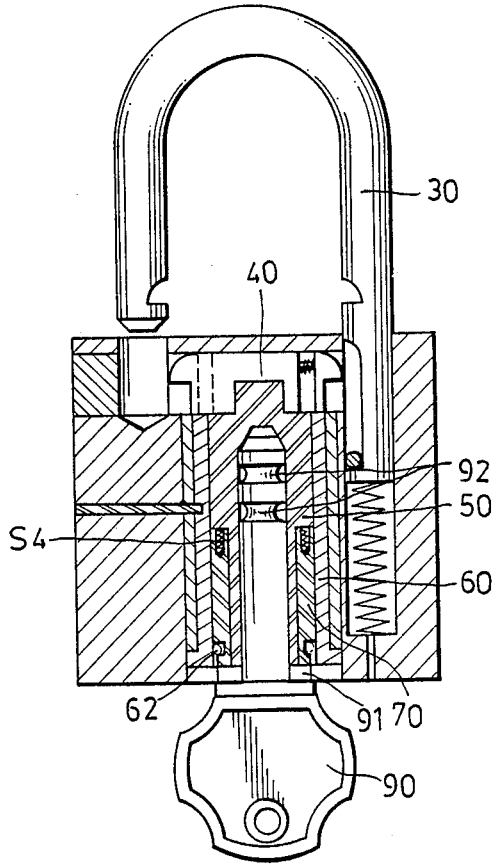
FIG. 7 is a sectional view of the padlock according to this invention when it is open.

Referring to FIG. 7, when a key 90 is inserted into the key hole 56 of the key plug 50, it engages the tumbler pins 631 with the second annular grooves 92 thereof so that the tumbler cylinders 632 are moved to entirely extend into the sleeve 60, thereby releasing the tumbler pin units 63. Meanwhile, the push blocks 91 of the key 90 move respective plates 70 upward to align the stop pins 62 with the cutouts 72 of the plates 70 so that the stop pins 62 can pass through the cutouts 72 and hence the entire first annular groove 51 of the key plug 50. The double lock between the key plug 50 and the sleeve 60 is therefore unlocked so that the operator can rotate the key 90 and hence the key plug 50 in the lock body 20 to push the bolt members 40 inward, thereby unlocking the shackle 30 from the bolt members 40. Because the shackle 30 is unlocked from the bolt members 40, it is pushed upward by the first spring S1 so that the short leg 31 of the shackle 30 separates from the body 20. The padlock is therefore opened forming the configuration shown in FIG. 7.

When it is desired to lock the padlock again, the shackle 30 is initially depressed to align the bolt members 40 with the notches 311 and 321 of the shackle 30. The key 90 is then rotated back to the original position and withdrawn from the key hole 56 of the key plug 50. The fourth spring S4 will push the plates 70 downward to obstruct the stop pins 62 from circulating.

With this invention thus explained, it is apparent that numerous modifications and variations can be made without departing from the scope and spirit of this invention. It is therefore intended that this invention be limited only as indicated in the appended claims.

I claim:

1. A padlock used with a cylindrical key, said cylindrical key including a plurality of first annular grooves formed in its outer surface, and two opposed push blocks extending radially from said key, each of said first annular grooves being spaced from upper ends of said push blocks at a predetermined distance, said padlock comprising:

(1) a lock body;

(2) a spring biased shackle having long and short legs connected movably to an upper portion of said body;

(3) a locking bolt member for retaining releasably said short leg of said shackle on said body;

(4) a sleeve fixed in said body;

(5) a key plug mounted rotatably within said sleeve and having a second annular groove formed in its outer surface, and two opposed channels formed vertically in said key plug and crossing said second annular groove, each of said channels having an open end in a bottom surface of said key plug;

(6) two stop pins, each fixed on said sleeve and extending through a portion of said second annular groove of said key plug near one of said channels;

(7) two spring biased tumbler plates, mounted slidably within said respective channels, each of said plates having a cutout therein and being biased to extend across a portion of said second annular groove of said key plug to obstruct said corresponding stop pin for preventing rotation of said key plug relative to said body; and (8) a plurality of spring biased tumbler pin units transversely extending through said sleeve and said key plug for preventing rotation of said key plug relative to said sleeve;

whereby, when said key is inserted into said key plug, said tumbler pin units engage with said respective first grooves so that said tumbler pin units are released, and said plates are moved by said respective push blocks to align said stop pins with said cutouts of said plates so that said stop pins can circulate along said second annular groove, thereby permitting rotation of said key plug relative to said body.

* * * * *